US008191700B2

(12) United States Patent
Chen et al.

(10) Patent No.: US 8,191,700 B2
(45) Date of Patent: Jun. 5, 2012

(54) BILL BOX HAVING A WIRELESS MEMORY FUNCTION FOR USE IN A BILL ACCEPTOR

(75) Inventors: Wei-Jr Chen, Taipei (TW); Cheng-Kang Yu, Taipei (TW); Yueh-Ping Hsu, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 13/182,766

(22) Filed: Jul. 14, 2011

(65) Prior Publication Data

US 2011/0266114 A1 Nov. 3, 2011

Related U.S. Application Data

(63) Continuation-in-part of application No. 12/475,618, filed on Jun. 1, 2009, now abandoned.

(51) Int. Cl.
*G07F 7/04* (2006.01)

(52) U.S. Cl. ..... 194/206; 340/572.8; 340/572.9; 361/679.31; 292/46; 292/256.63; 312/223.1; 902/13; 194/350

(58) Field of Classification Search ..... 194/206, 194/207, 350, 353; 902/13; 209/534; 340/572.8, 340/572.9; 361/679.31, 679.32; 292/46, 292/256.63, 257; 16/60; 312/223.1, 223.2
See application file for complete search history.

(56) References Cited

U.S. PATENT DOCUMENTS

| | | | |
|---|---|---|---|
| 5,411,249 | A | 5/1995 | Zouzoulas |
| 5,863,039 | A | 1/1999 | Suzuki |
| 5,896,974 | A | 4/1999 | Chang |
| 7,481,308 | B2 | 1/2009 | Bergeron et al. |
| 2003/0127790 | A1 | 7/2003 | Chou |
| 2003/0230464 | A1 | 12/2003 | Deaville et al. |
| 2006/0081441 | A1 | 4/2006 | Vysma et al. |
| 2007/0072064 | A1 | 3/2007 | Wells et al. |
| 2007/0103857 | A1 | 5/2007 | Weech et al. |
| 2008/0246615 | A1 | 10/2008 | Duron et al. |

*Primary Examiner* — Jeffrey Shapiro
(74) *Attorney, Agent, or Firm* — Muncy, Geissler, Olds & Lowe, PLLC

(57) ABSTRACT

A bill box for use in a bill acceptor having a RFID read/write module and adapted for receiving bills from the bill acceptor is disclosed to include a housing having a bracket provided with locating grooves, bottom plates, stop plates, finger slot and stop grooves and suspending therein and dividing the internal space of the housing into a bill storage chamber and a partition chamber, and a memory carrier provided with stop blocks, retaining lugs, springy retainer and stop strips for quick mounting in the bracket in a detachable manner and carrying a wireless memory device for recording bill storage data by the wireless read/write module of the bill acceptor wirelessly for quick data check.

9 Claims, 8 Drawing Sheets

BILL BOX HAVING A WIRELESS MEMORY FUNCTION FOR USE IN A BILL ACCEPTOR

This application is a Continuation-In-Part of application Ser. No. 12/475,618, filed on Jun. 1, 2009, now abandoned. The patent application identified above is incorporated here by reference in its entirety to provide continuity of disclosure.

BACKGROUND OF THE INVENTION

1. Field of the Invention

The present invention relates to bill boxes for bill acceptor and more particularly, to a bill box having a wireless memory function, which uses a memory carrier carrying a Wireless memory device and detachably mounted in a bracket in the housing thereof for enabling the bill acceptor to record the data of the total value of the storage bills wirelessly.

2. Description of the Related Art

Following fast development of technology, the distance among people has been greatly shortened, our mode of living has been changed, and different automatic vending machines are used everywhere to sell different products without serviceman. These automatic vending machines are highly invited for the advantage of saving much labor and bringing convenience to people.

For the advantages of scientific intelligence, quick service, and quick finish of payment, Q-shop breaks through the conventional sales and marketing barriers. A Q-shop may provide automatic vending machines for vending drinks, cigarettes, tickets, ice creams, tickets, memorial coins, key rings, or even hamburgers and noodles. Nowadays, many virtual shops are established to make online shopping, allowing shoppers to shop across millions of products.

An automatic vending machine generally comprises a bill/coin acceptor to recognize the authenticity and value of each inserted bill/coin, and a bill/coin box for storing each received bill/coin. Workers regularly visit installed automatic vending machines to take back the installed bill/coin box from each installed automatic vending machine and to install an empty bill/coin box in each installed automatic vending machine as a substitute. The collected bill/coin boxes are carried back to the company for checking the storage bills/coins. After removal of a bill/coin box from an automatic vending machine, any person of the company does not know the actual total amount of the bills/coins in the bill/coin box, i.e., the company does not know the actual total transaction amount of every automatic vending machine before opening the bill/coin box. This management process cannot prevent workers from stealing money from bill/coin boxes.

SUMMARY OF THE INVENTION

The present invention has been accomplished under the circumstances in view. It is one object of the present invention to provide a bill box with wireless memory function, which carries a wireless memory device for enabling the bill acceptor to record the data of bill storage amount and value.

To achieve this and other objects of the present invention, a bill box comprises a housing, and a memory carrier mounted in a bracket inside the housing and carrying a wireless memory, for example, RFID memory. After installation of the bill box in a bill acceptor having a circuit board with a RFID read/write module, the wireless memory device is kept adjacent to the RFID read/write module. Each time the bill acceptor recognizes and receives a real bill, the RFID read/write module writes the related data into the wireless memory device wirelessly. Therefore, the wireless memory device of the bill box can record the face value of each received bill for easy checking. Further, after removal of the bill box from the bill acceptor, the bill box can be attached with the side on which the Wireless memory device is located to a display device having a RFID read/write module, enabling the RFID read/write modull to read in storage data from the wireless memory device wirelessly for display on the display screen of the display device for sales record checking when counting the collected bills.

Further, if the wireless memory device fails, a maintenance engineer can get the key from the authorized person and open the access door, and then insert the fingers into the finger slot of the bracket and to further disengage the springy retainer of the memory carrier from the locating grooves and then to take the memory carrier away from the mounting chamber of the bracket for a repair work. As it is not necessary to replace the whole bill box when the wireless memory device failed, the maintenance cost is minimized.

Further, by means of stopping the blocks of the memory carrier against the top plates of the bracket and engaging the stop strips of the memory carrier into the stop grooves of the bracket and forcing the retaining lugs and springy retainer of the memory carrier into the respective locating grooves and finger slot of the bracket, the memory carrier is firmly secured to the bracket without vibration.

Further, during installation of the memory carrier, it simply needs to obliquely insert one side of the memory carrier opposite to the springy retainer into the mounting chamber of the bracket and then to bias the memory carrier and to further force the respective retaining protrusions into the respective locating grooves, and thus, the installation of the memory carrier is done. When going to dismount the memory carrier, impart a pressure to the springy retainer to disengage the respective retaining protrusions from the respective locating grooves, and then bias the memory carrier and remove the memory carrier from the bracket. This design facilitates mounting and dismounting of the memory carrier with one single hand. Further, after installation of the memory carrier in the bracket, the curved base panel of the springy retainer is also kept in the partition chamber without hindering the operation of the bill bearing plate and the spring members in the bill storage chamber in receiving bills, avoiding possible bill jams or component damage.

DETAILED DESCRIPTION OF THE PREFERRED EMBODIMENT

Referring to FIGS. 1~4 and FIG. 7, a bill box for use in a bill acceptor in accordance with the present invention is shown comprising a housing 1 and a memory carrier 2.

Figure 1:
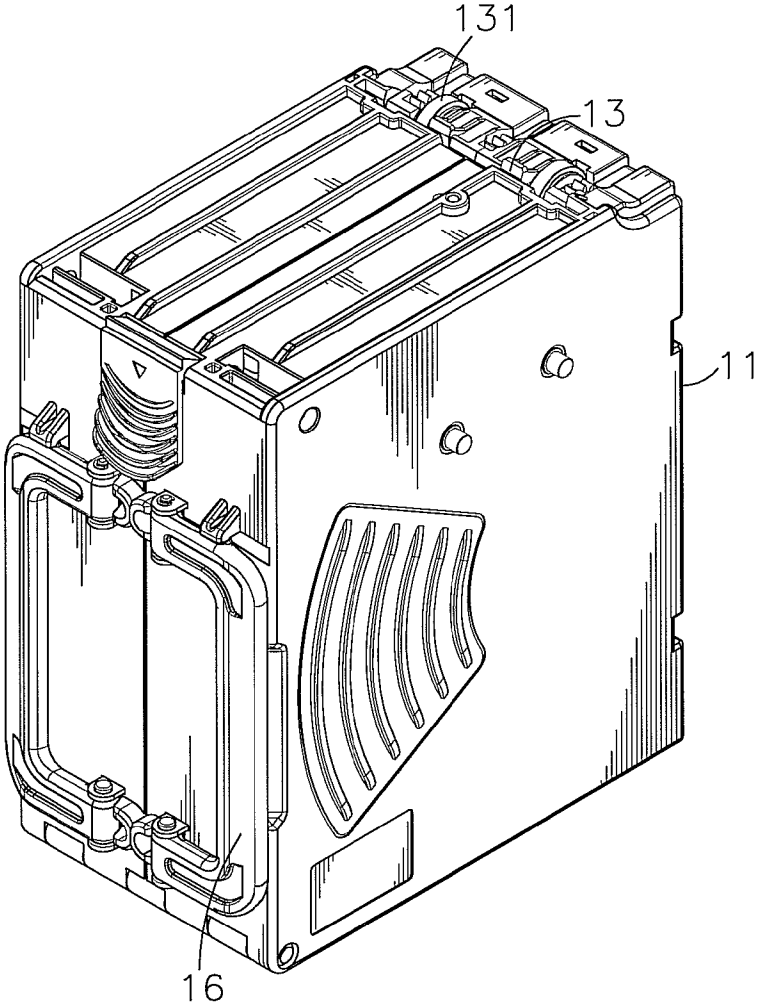
FIG. 1 is an oblique elevation of a bill box in accordance with the present invention.
Figure 2:
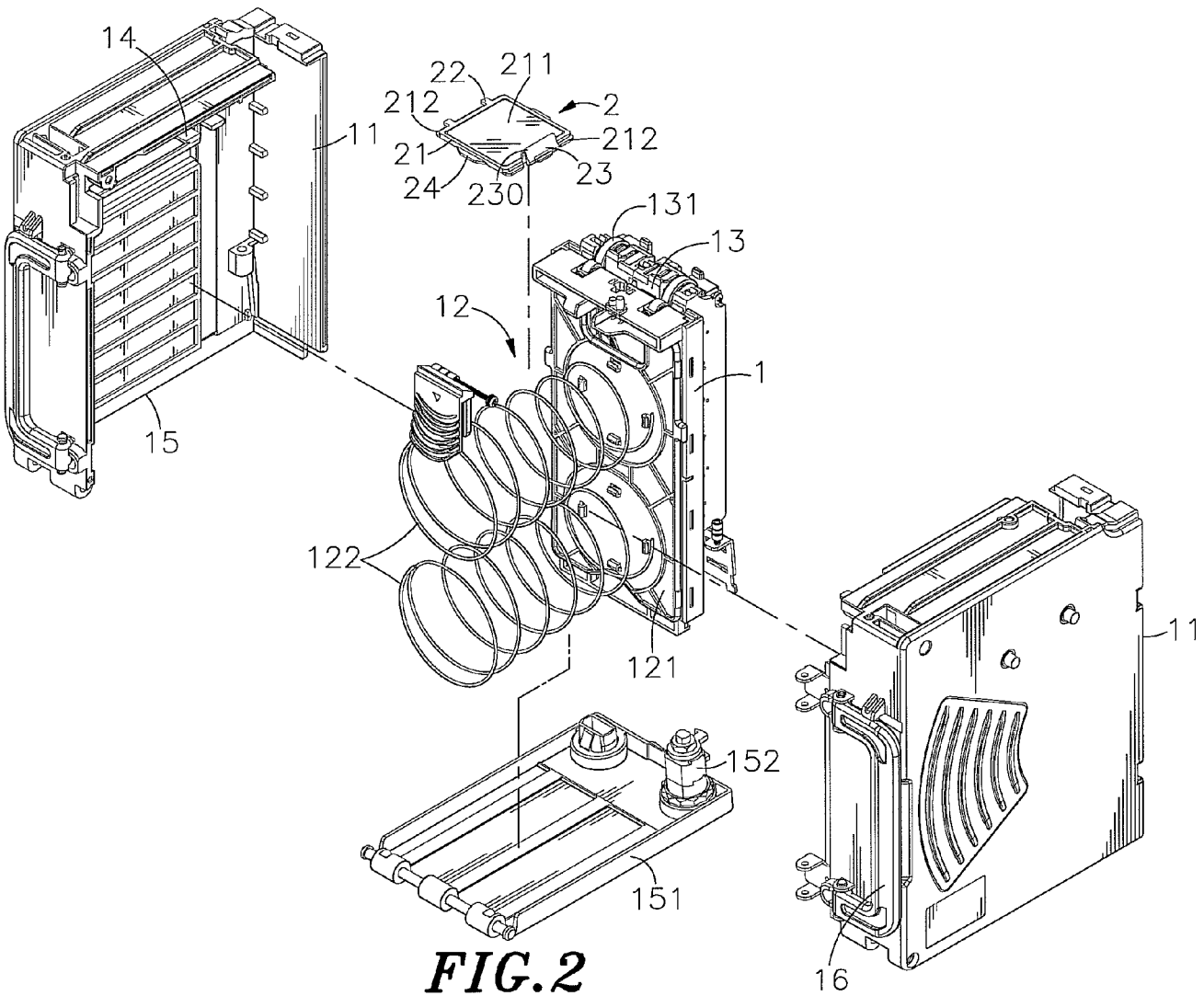
FIG. 2 is an exploded view of the bill box in accordance with the present invention.
Figure 3:
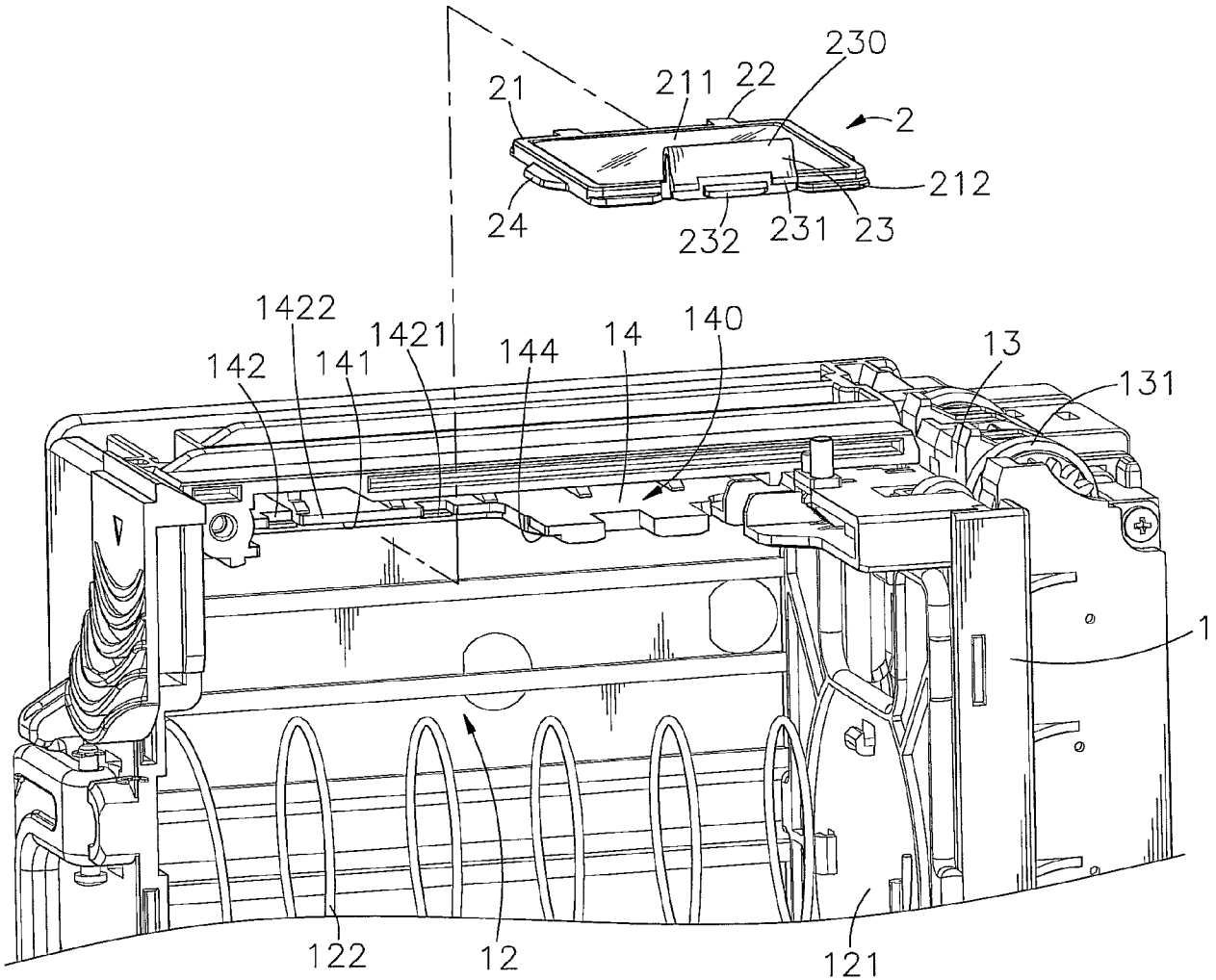
FIG. 3 is an enlarged view of a part of FIG. 2.
Figure 4:
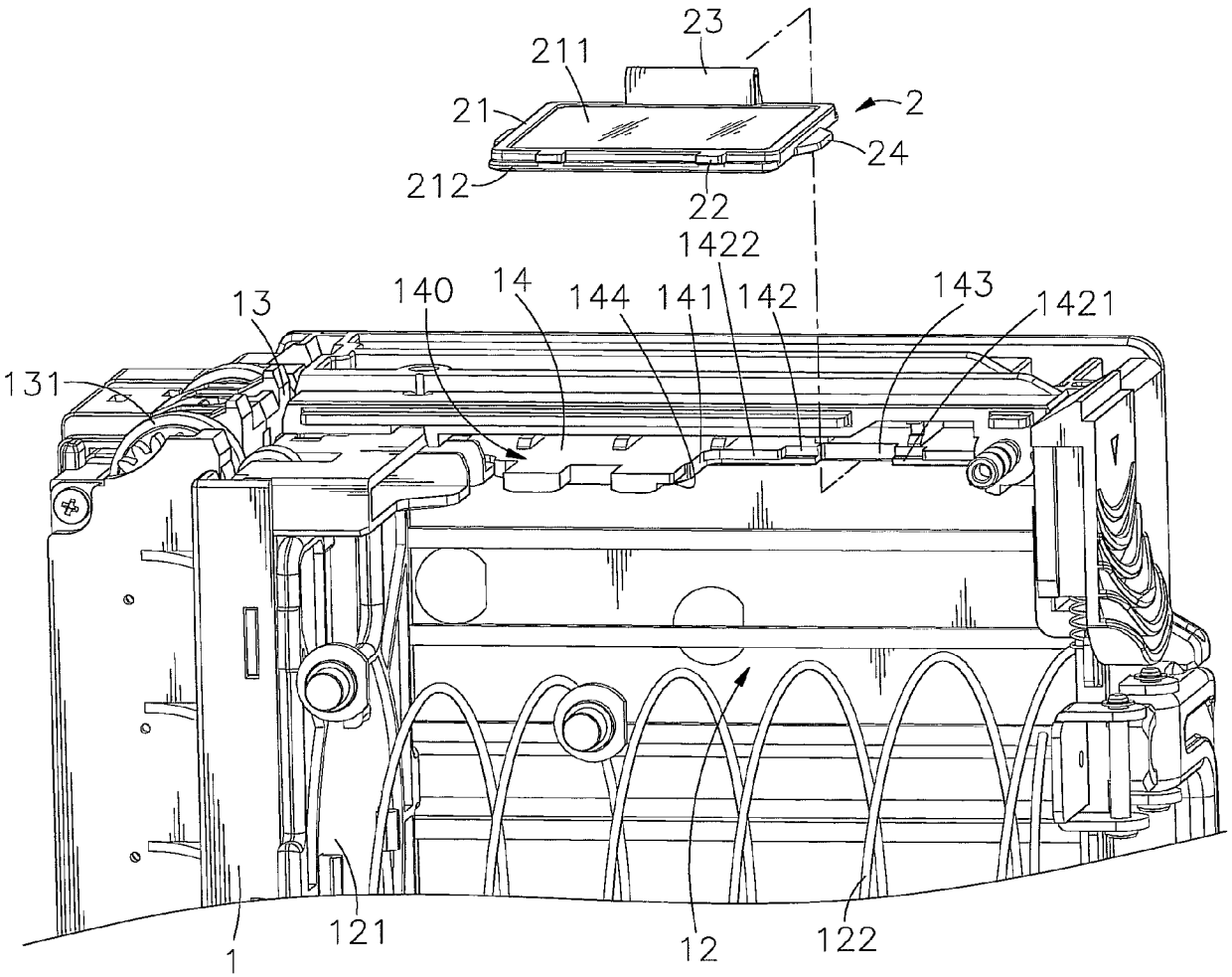
FIG. 4 corresponds to FIG. 3 when viewed from another angle.
Figure 5:
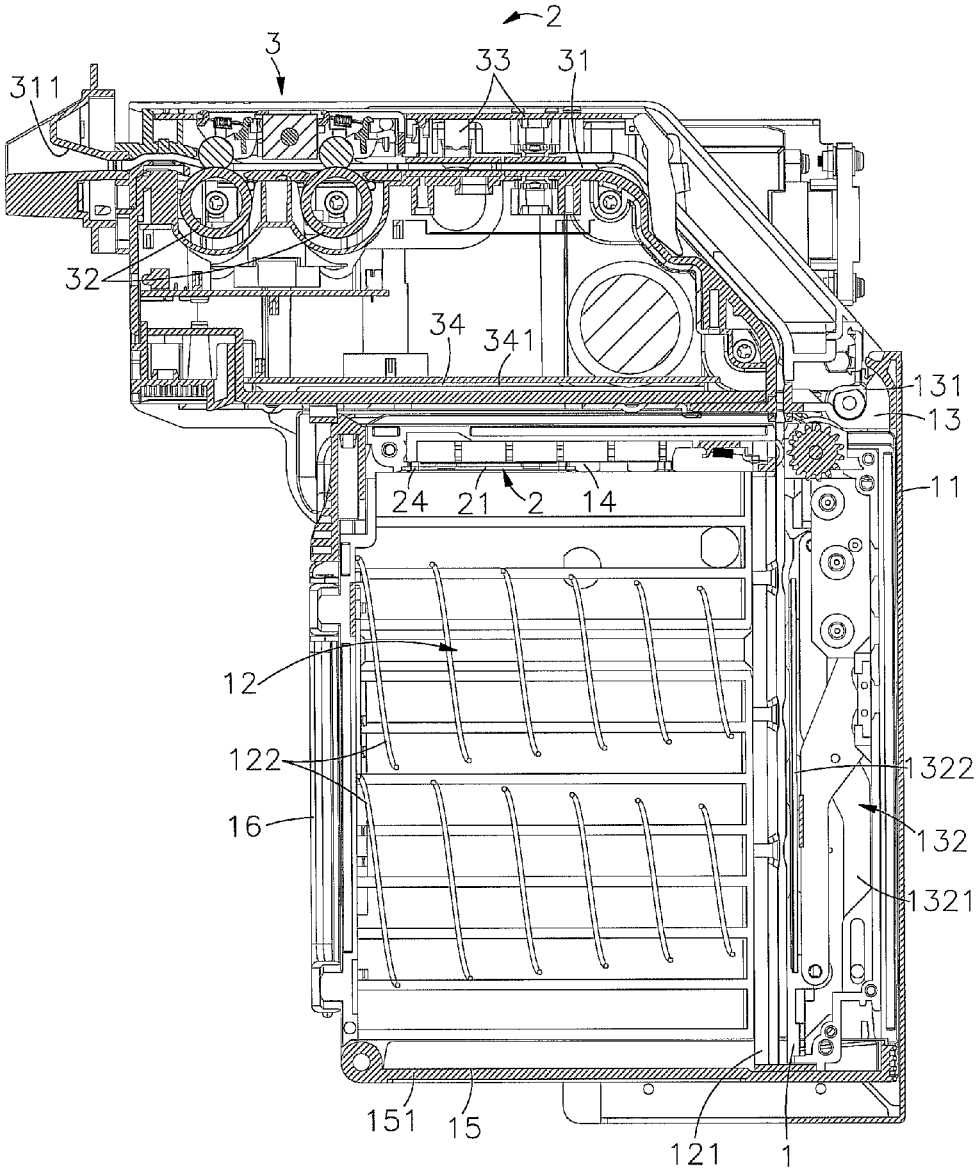
FIG. 5 is a sectional view of the present invention, illustrating the bill box installed in a bill acceptor.

The housing 1 comprises a plurality of cover shells 11, a bill inlet 13 disposed near one side thereof, a bill storage chamber 12 defined therein in communication with the bill inlet 13 for receiving bills been transferred into the bill inlet 13, a bill transferring mechanism 131 arranged at two opposite lateral sides of the bill inlet 13 and adapted to transfer bills from a bill acceptor (not shown) through the bill inlet 13 into the bill storage chamber 12, a bill bearing plate 121 suspending in the bill storage chamber 12 for holding bills in the bill storage chamber 12, a plurality of spring members 122 mounted inside the bill storage chamber 12 and adapted to impart a pressure to the bill bearing plate 121 toward the bill inlet 13, a bill press mechanism 132, which comprises a plurality of links 1321 and a bill press board 1322 movable by the links 1321 to push bills away from the bill inlet 13 onto the bill bearing plate 121, a bracket 14 located on the top side thereof adjacent to the bill acceptor 3 (see also FIG. 5) and defining a partition chamber 140 in the housing 1 outside the bill storage chamber 12, an access hole 15 defined in the bottom side thereof opposite to the bracket 14, an access door 151 hinged to one side of the access hole 15 and adapted to close the access hole 15, a door lock 152 mounted in the access door 151 for locking the access door 151 in the close position, and a handle 16 located on one cover shell 11 at the front side of the housing 1 opposite to the bill inlet 13. The bracket 14 comprises a mounting chamber 141 in communication between the bill storage chamber 12 and the partition chamber 140, a plurality of locating grooves 142 disposed at two opposite lateral sides of the mounting chamber 141, a bottom plate 1421 respectively disposed at the bottom side of each of the locating grooves 142 adjacent to the bill storage chamber 12, a stop plate 1422 respectively protruded from one side of each of the locating grooves 142 remote from the respective bottom plate 1421, a finger slot 143 disposed adjacent to one locating groove 142 in communication between the bill storage chamber 12 and the partition chamber 140 and having a depth greater than the locating groove 142, and a plurality of stop grooves 144 formed in the mounting chamber 141 at front and rear sides relative to the locating grooves 142 and the finger slot 143 and kept in communication with the bill storage chamber 12.

The memory carrier 2 comprises a substrate 21 mounted in the mounting chamber 141 of the bracket 14, a wireless memory device, for example, RFID memory 211 installed in the substrate 21 and facing toward the partition chamber 140, a plurality of stop blocks 212 protruded from the substrate 21 and respectively stopped against the top plates 1422 of the bracket 14, a plurality of retaining lugs 22 protruded from one lateral side of the substrate 21 and respectively engaged into respective locating grooves 142 of the bracket 14, a springy retainer 23 upwardly extended from the other lateral side of the substrate 21 and engaged into at least one of the locating grooves 142 and finger slot 143 of the bracket 14, and a plurality of stop strips 24 respectively protruded from the front and rear sides of the substrate 21 and respectively engaged into the stop grooves 144 of the bracket 14. The springy retainer 23 comprises a curved base panel 230 perpendicularly extended from one lateral side of the substrate 21 toward the partition chamber 140 and then turned backwards, a variable space 2300 surrounded by the curved base panel 230, at least one retaining protrusion 231 protruded from the free end of the curved base panel 230 and respectively engaged into one respective locating groove 142 of the bracket 14, and a locating block 232 extended from the free end of the curved base panel 230 and engaged into the finger slot 143 of the bracket 14. Further, each retaining protrusion 231 has a beveled guide face 2311 located on the top side thereof to facilitate insertion of the respective retaining protrusion 231 into the respective locating groove 142 of the bracket 14.

Referring to FIG. 5 and FIGS. 2~4 again, the bill box is installed in one side of the bill acceptor 3. The bill acceptor 3 comprises a bill insertion slot 311 located on the front side thereof, a bill passage 31 backwardly extended from the bill insertion slot 311 and kept in communication with the bill inlet 13 of the bill box, a bill transfer mechanism 32 arranged on top and bottom sides of the bill passage 31 for transferring each inserted bill from the bill insertion slot 311 through the bill passage 31 into the bill inlet 13 of the bill box, a recognition module 33 installed in one side of the bill passage 31 for checking the authenticity and face value of each inserted bill, and a circuit board 34 disposed adjacent to the housing 1 of the bill box. The circuit board 34 comprises a RFID read/write module 341.

When a bill is inserted through the bill insertion slot 311 of the bill acceptor 3 into the bill passage 31, the bill transfer mechanism 32 transfers the inserted bill forwardly to a predetermined position for recognition by the recognition module 33. If the inserted bill is a counterfeit bill, the bill transfer mechanism 32 reverses the counterfeit bill to the bill insertion slot 311. If the inserted bill is a true bill, the bill transfer mechanism 32 immediately transfers the bill to the bill inlet 13 of the bill box at rear end of the bill passage 31, enabling the bill to be carried forwardly by the bill transferring mechanism 131 into the inside of the bill inlet 13. At this time, the links 1321 of the bill press mechanism 132 are driven to move the bill press board 1322, causing the bill press board 1332 to push the bill away from the bill inlet 13 to the bill bearing plate 121 in the bill storage chamber 12 against the spring members 122. Thus, the bill is stored in the bill storage chamber 12.

Figure 6:
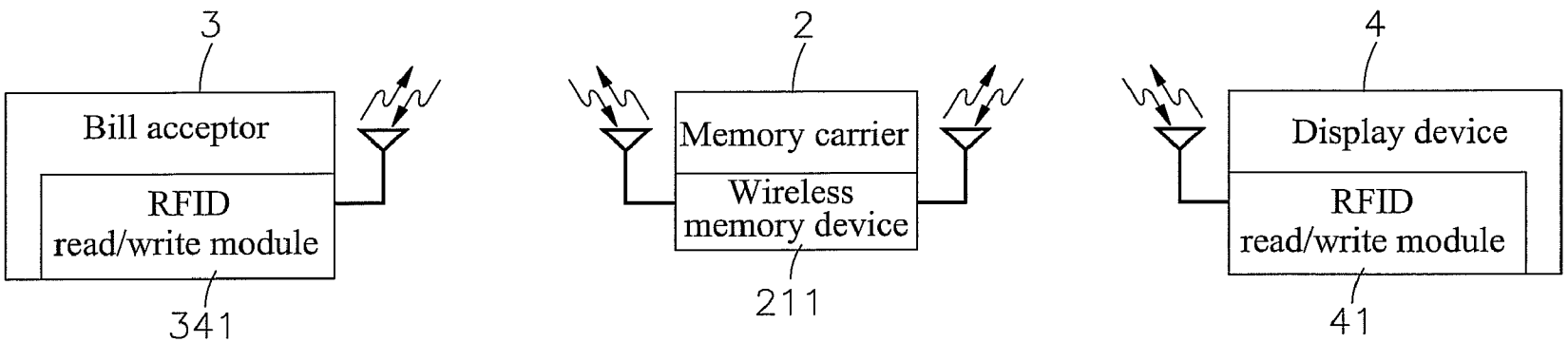
FIG. 6 is a system block diagram of the present invention.
Figure 7:
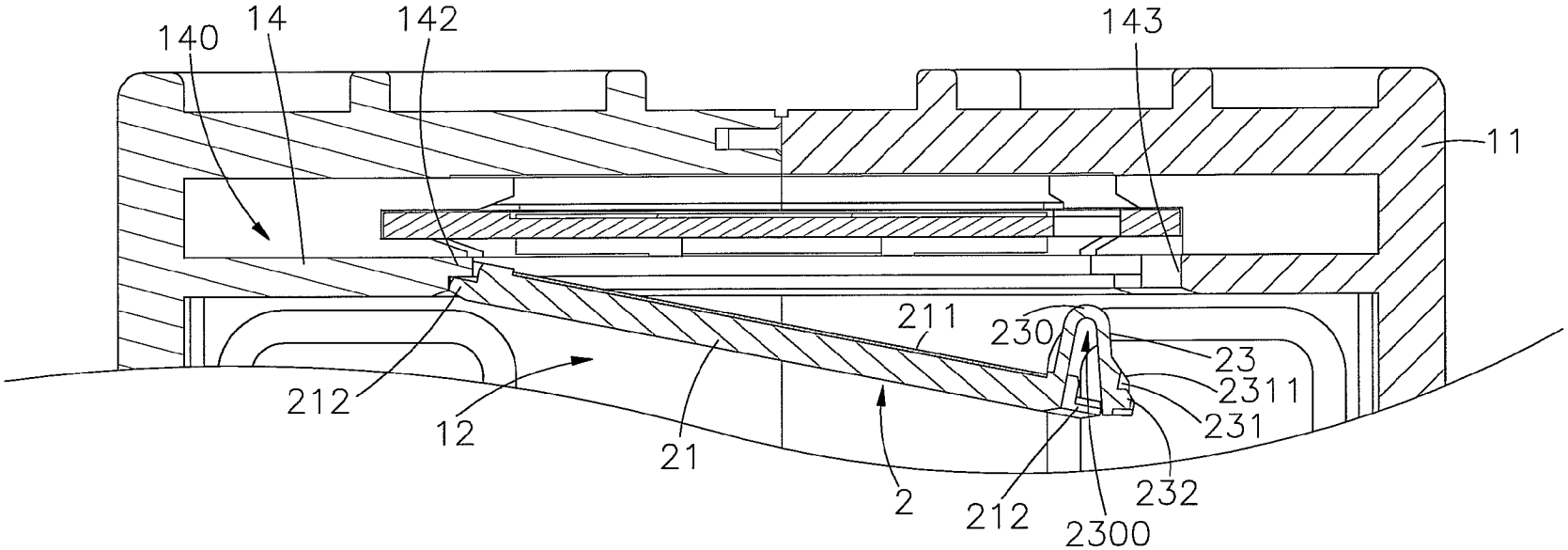
FIG. 7 is a schematic sectional side view of a part of the present invention, illustrating the installation of the memory carrier installed in the bracket inside the housing.
Figure 8:
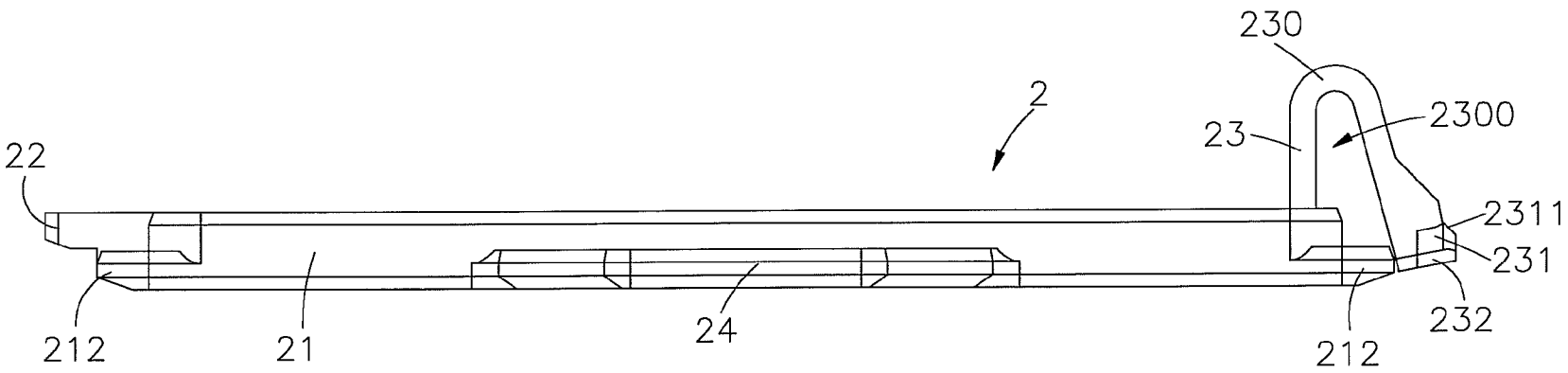
FIG. 8 is a side plain view of the memory carrier in accordance with the present invention.

Referring to FIG. 6 and FIG. 5 again, after recognition of the authenticity and face value of the inserted bill by the recognition module 33, the recognition module 33 immediately transmits the related data to the RFID read/write module 341 of the circuit board 34. Upon receipt of the data from the recognition module 33, the RFID read/write module 341 transmits the data to the wireless memory device 211 and stores the data in the wireless memory device 211 wirelessly. When an authorized person detached the bill box from the bill acceptor 3, the authorized person can grasp the handle 16 of the bill box to carry the bill box to a display device 4 having a RFID read/write module 41 and then to attach one side of the bill box to the display device 4 for enabling the RFID read/write module 41 of the display device 4 to read the storage data from the wireless memory device 211 of the bill box and to display the data on a display screen thereof.

The RFID read/write module 341 of the bill acceptor 3 and the RFID read/write module 41 of the display device 4 commonly consist of an antenna and a transceiver and are capable of reading and/or writing to a RFID memory. Because RFID technology is of the known art, no further detailed description in this regards is necessary.

Referring to FIGS. 7 and 8 and FIGS. 2~5 again, the bill boxes in regular bill acceptors must be regularly exchanged with empty ones by staffs or security persons so that storage bills can be collected and counted. It is inconvenient and takes much labor and time to mount and dismount bill boxes, to deliver bill boxes, to collect storage bills from bill boxes, to count the amount of collected bills, and to check the total value of the collected bills with the data recorded in the bill acceptors. The invention eliminates this problem. The bill acceptor 3 of the invention can be attached to the display device 4 in a top-down position for enabling the RFID read/ write module 41 of the display device 4 to read the storage data from the wireless memory device 211 of the bill box and to display the data on the display screen of the display device 4. At this time, the company staff or security person can unlock the door lock 152 and open the access door 151, and then take the storage bills out of the access hole 15 of the bill box, and then check the total value of the bills with the data displayed on the display screen of the display device 4.

Further, the wireless memory device 211 is installed in the memory carrier 2, and the memory carrier 2 is mounted in the mounting chamber 141 of the bracket 14 inside the housing 1 in an inclined position. During installation, the retaining lugs 22 of the memory carrier 2 are inserted through the mounting chamber 141 and respectively forced into respective locating grooves 142 of the bracket 14 to have the stop blocks 212 of the memory carrier 2 be respectively stopped against the top plates 1422 of the bracket 14, and then the springy retainer 23 is moved with the memory carrier 2 toward the bracket 14 to force the respective stop strips 24 into the respective stop grooves 144 of the bracket 14 and to move the beveled guide face 2311 of each retaining protrusion 231 over the respective bottom plate 1421 and to elastically deform each retaining protrusion 231 and to further force each retaining protrusion 231 over the respective bottom plate 1421 into the respective locating groove 142. At this time, the curved base panel 230 is suspending in the partition chamber 140 and the locating block 232 is forced into the finger slot 143 of the bracket 14, and therefore the memory carrier 2 is firmly secured to the bracket 14 inside the housing 1 and prohibited from displacement relative to the bracket 14 during delivery of the bill box.

If the wireless memory device 211 fails, the memory carrier 2 must be detached from the bracket 14 for repair. At this time, the maintenance engineer can unlock the door lock 152 with a key and then open the access door 151, and then push the bill bearing plate 121 with one hand to compress the spring members 122 and insert the other hand into the bill storage chamber 12 and the finger slot 143 of the bracket 14 to move the locating block 232 and to elastically deform the curved base panel 230 of the springy retainer 23 in changing the volume of the variable space 2300, thereby disengaging each retaining protrusion 231 from the respective locating groove 142. Thereafter, move the springy retainer 23 and the memory carrier 2 toward the bill storage chamber 12, and then bias the memory carrier 2 relative to the bracket 14 toward the inside of the bill storage chamber 12 to disengage the springy retainer 23 from the bracket 14 when keeping the retaining lugs 22 of the memory carrier 2 in the respective locating grooves 142 of the bracket 14 against the respective bottom plate 1421, and then move the memory carrier 2 away from the bracket 14 obliquely for a further repair work. Further, when going to take the memory carrier 2 away from the bracket 14, it is necessary to unlock the door lock 152 and open the access door 151 at first. As the key is held in the hand of an authorized person and the wireless memory device 211 has recorded therein the total value of the bills accommodated in the bill box, the invention effectively prevents any non-authorized person from stealing bills from the bill box or replacing the wireless memory device 211, assuring a high level of security.

Further, to fit market requirements for small-sized products, the dimension of the bill box is limited. However, in order to reduce the bill box exchange frequency, the volume of the bill storage chamber must be made as greater as possible. When increasing the bill storage chamber without changing the total dimension of the bill box, the internal space of the bill box available for a wireless memory device is limited. The invention uses the bracket 14 to divide the internal space of the housing 1 into a bill storage chamber 12 and a partition chamber 140 and to carry the memory carrier 2, keeping the wireless memory device 211 and the curved base panel 230 of the springy retainer 23 of the memory carrier 2 in the partition chamber 140 so that the bills, the bill bearing plate 121 and the spring members 122 in the bill storage chamber 12 does not touch the springy retainer 23 or any other part of the memory carrier 2, avoiding springy retainer damage or bill jams.

Further, the bracket 14 has a certain structural strength. Further, the size of the mounting chamber 141 of the bracket 14 and the size of the memory carrier 2 are limited, facilitating mounting and dismounting of the memory carrier 2. Minimizing the size of the memory carrier 2 facilitates the worker to see the locations of the mounting chamber 141, the locating grooves 142, the finger slot 143 and the stop grooves 144 at the bracket 14 during installation of the memory carrier 2.

In conclusion, the invention provides a bill box having a memory function that has the following features and advantages:

1.The housing 1 of the bill box has a memory carrier 2 with a wireless memory device 211 mounted therein. After installation of the bill box in a bill acceptor 3 having a circuit board 34 with a RFID read/write module 341, the wireless memory device 211 is kept adjacent to the RFID read/write module 341. Each time the bill acceptor 3 recognizes and receives a real bill, the RFID read/write module 341 writes the related data into the wireless memory device 211 wirelessly. Therefore, the wireless memory device 211 of the bill box can record the face value of each received bill for easy checking.

2. After removal of the bill box from the bill acceptor 3, the bill box can be attached with the side on which the wireless memory device 211 is located to a display device 4 having a RFID read/write module 41, enabling the RFID read/write module 41 to read in storage data from the wireless memory device 211 wirelessly for display on the display screen of the display device 4 for sales record checking when counting the collected bills.

3. If the wireless memory device 211 fails, a maintenance engineer can get the key from the authorized person and open the access door 151, and then insert the fingers into the finger slot 143 of the bracket 14 and to further disengage the springy retainer 23 of the memory carrier 2 from the locating grooves 142 and then to take the memory carrier 2 away from the mounting chamber 141 of the bracket 14 for a repair work. As it is not necessary to replace the whole bill box when the wireless memory device 211 failed, the maintenance cost is minimized.

4. By means of stopping the blocks 212 of the memory carrier 2 against the top plates 1422 of the bracket 14 and engaging the stop strips 24 of the memory carrier 2 into the stop grooves 144 of the bracket 14 and forcing the retaining lugs 22 and springy retainer 23 of the memory carrier 2 into the respective locating grooves 142 and finger slot 143 of the bracket 14, the memory carrier 2 is firmly secured to the bracket 14 without vibration.

5. During installation, it simply needs to obliquely insert one side of the memory carrier 2 opposite to the springy retainer 23 into the mounting chamber 141 of the bracket 14 and then to bias the memory carrier 2 and to further force the respective retaining protrusions 231 into the respective locating grooves 142, and thus, the installation of the memory carrier 2 is done. When going to dismount the memory carrier 2, impart a pressure to the springy retainer 23 to disengage the respective retaining protrusions 231 from the respective locating grooves 142, and then bias the memory carrier 2 and remove the memory carrier 2 from the bracket 14. This design facilitates mounting and dismounting of the memory carrier 2 with one single hand.

6. The wireless memory device 211 is carried in the memory carrier 2 and facing toward the partition chamber 140. After installation of the memory carrier 2 in the bracket 14, the curved base panel 230 of the springy retainer 23 is also kept in the partition chamber 140 without hindering the operation of the bill bearing plate 121 and the spring members 122 in the bill storage chamber 12 in receiving bills, avoiding possible bill jams or component damage.

A prototype of bill box having a wireless memory function for bill acceptor has been constructed with the features of FIGS. 1~8. The bill box having a wireless memory function for bill acceptor functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A bill box used in a bill acceptor having a wireless read/write module and adapted for receiving bills from said bill acceptor, comprising:

a housing formed of a plurality of cover shells, said housing comprising a bill inlet for receiving bills from said bill acceptor, a bracket inwardly extended from a top side thereof and dividing the internal space of said housing into a bill storage chamber and a partition chamber, said bracket comprising a mounting chamber in communication between said bill storage chamber and said partition chamber, a plurality of locating grooves disposed at two opposite lateral sides of said mounting chamber, a bottom plate respectively disposed at a bottom side of each said locating groove adjacent to said bill storage chamber, a stop plate respectively protruded from one side of each said locating groove remote from the respective bottom plate, a finger slot disposed adjacent to one said locating groove in communication between said bill storage chamber and said partition chamber, and a plurality of stop grooves formed in said mounting chamber at front and rear sides relative to said locating grooves and said finger slot and kept in communication with said bill storage chamber; and a memory carrier mounted in said bracket, said memory carrier comprising a substrate mounted in said mounting chamber of said bracket, a wireless memory device installed in said substrate and facing toward said partition chamber, a plurality of stop blocks protruded from said substrate and respectively stopped against the top plates of said bracket, a plurality of retaining lugs protruded from one lateral side of said substrate and respectively engaged into respective locating grooves of said bracket, a springy retainer upwardly extended from an opposite lateral side of said substrate and engaged into at least one of said locating grooves and said finger slot of said bracket, and a plurality of stop strips respectively protruded from front and rear sides of said substrate and respectively engaged into the stop grooves of said bracket, said springy retainer comprising a curved base panel perpendicularly extended from one lateral side of said substrate toward said partition chamber and then turned backwards, a variable space surrounded by said curved base panel, at least one retaining protrusion protruded from a distal end of said curved base panel and respectively engaged into one respective locating groove of said bracket and a locating block extended from the distal end of said curved base panel and engaged into said finger slot of said bracket.

2. The bill box as claimed in claim 1, wherein said housing further comprises a bill bearing plate suspending in said bill storage chamber for holding bills in said bill storage chamber, a plurality of spring members mounted inside said bill storage chamber and adapted to impart a pressure to said bill bearing plate toward said bill inlet, and a bill press mechanism adapted to push each bill being delivered into said bill inlet away from said bill inlet to said bill bearing plate.

3. The bill box as claimed in claim 2, wherein said bill press mechanism comprises a plurality of links, and a bill press board movable by said links to push each bill being delivered into said bill inlet away from said bill inlet to said bill bearing plate.

4. The bill box as claimed in claim 1, wherein said housing further comprises a bill transferring mechanism arranged at two opposite lateral sides relative to said bill inlet and adapted to transfer bills from said bill acceptor through said bill inlet into said bill storage chamber.

5. The bill box as claimed in claim 1, wherein said housing further comprises an access hole, and an access door adapted to close said access hole.

6. The bill box as claimed in claim 5, wherein said housing further comprises a door lock adapted for locking said access door.

7. The bill box as claimed in claim 1, wherein said wireless memory device is a RFID memory.

8. The bill box as claimed in claim 1, wherein said housing further comprises a handle located on one cover shell thereof.

9. The bill box as claimed in claim 1, wherein each said retaining protrusion of said springy retainer of said memory carrier has a beveled guide face located on a top side thereof.

* * * * *